US007114572B2

(12) United States Patent
Batho et al.

(10) Patent No.: US 7,114,572 B2
(45) Date of Patent: Oct. 3, 2006

(54) SYSTEM AND METHOD FOR OFFSHORE PRODUCTION WITH WELL CONTROL

(75) Inventors: Peter F. Batho, Houston, TX (US); David E. McCalvin, Missouri City, TX (US); Randall A. Shepler, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 140 days.

(21) Appl. No.: 10/758,639

(22) Filed: Jan. 15, 2004

(65) Prior Publication Data

US 2005/0155767 A1 Jul. 21, 2005

(51) Int. Cl.
*E21B 43/12* (2006.01)
*E21B 34/10* (2006.01)
*F04F 5/48* (2006.01)

(52) U.S. Cl. ..... 166/370; 166/68; 166/105; 166/374; 417/191

(58) Field of Classification Search ..... 166/372–375, 166/369, 370, 68, 69, 105; 417/190, 191
See application file for complete search history.

(56) References Cited

U.S. PATENT DOCUMENTS

| | | | | |
|---|---|---|---|---|
| 1,720,863 A | | 7/1929 | Stebbins | |
| 2,114,780 A | | 4/1938 | Juelson | |
| 2,158,717 A | | 5/1939 | Brock | |
| 2,732,032 A | | 1/1956 | Sandison | |
| 2,744,721 A | | 5/1956 | Hatch | |
| 3,155,177 A | * | 11/1964 | Anderson | 175/67 |
| 3,289,608 A | | 12/1966 | Laval, Jr. | |
| 3,512,651 A | | 5/1970 | Laval, Jr. | |
| 3,605,887 A | | 9/1971 | Lambie | |
| 3,765,483 A | | 10/1973 | Vencil | |
| 3,944,380 A | | 3/1976 | Kampe | |
| 4,047,912 A | | 9/1977 | Markland | |
| 4,066,552 A | | 1/1978 | Caine | |
| 4,072,481 A | | 2/1978 | Laval, Jr. | |
| 4,155,681 A | | 5/1979 | Linko, III et al. | |
| 4,183,722 A | | 1/1980 | Roeder | |
| 4,294,573 A | | 10/1981 | Erickson et al. | |
| 4,330,306 A | | 5/1982 | Salant | |
| 4,390,061 A | | 6/1983 | Short | |
| 4,444,251 A | * | 4/1984 | Lefebvre et al. | 166/105 |
| 4,588,351 A | | 5/1986 | Miller | |
| 4,790,376 A | | 12/1988 | Weeks | |
| 4,971,518 A | | 11/1990 | Florin | |
| 4,988,389 A | * | 1/1991 | Adamache et al. | 166/302 |

(Continued)

FOREIGN PATENT DOCUMENTS

GB 2239676 7/1971

(Continued)

OTHER PUBLICATIONS

P.M. Carvalho, A.L. Podio, K. Sepehmoori, entitled "Modeling A Jet Pump With An Electrical Submersible Pump For Production Of Gassy Petroleum Wells", SPE 48934, pp. 1-13, 1986, Society of Petroleum Engineers, Inc.

(Continued)

*Primary Examiner*—Kenneth Thompson
(74) *Attorney, Agent, or Firm*—Robert A. VanSomeren; Bryan P. Galloway; Jaime A. Castano

(57) ABSTRACT

A system and method is provided for artificially lifting fluids from a formation. The system utilizes a production control unit having a jet pump assembly and valving to both lift the desired fluids and to provide well control.

18 Claims, 2 Drawing Sheets

U.S. PATENT DOCUMENTS

| | | | | |
|---|---|---|---|---|
| 5,000,769 | A | 3/1991 | Raguideau et al. | |
| 5,033,545 | A | 7/1991 | Sudol | |
| 5,277,232 | A | 1/1994 | Borsheim | |
| 5,368,735 | A | 11/1994 | Ford | |
| 5,372,190 | A | 12/1994 | Coleman | |
| 5,482,117 | A | 1/1996 | Kolpak et al. | |
| 5,555,934 | A | 9/1996 | Haufler | |
| 5,562,161 | A | 10/1996 | Hisaw et al. | |
| RE35,454 | E | 2/1997 | Cobb | |
| 5,662,167 | A | 9/1997 | Patterson et al. | |
| 5,667,364 | A * | 9/1997 | O Mara et al. | 417/151 |
| 5,881,814 | A | 3/1999 | Mills | |
| 5,992,521 | A * | 11/1999 | Bergren et al. | 166/265 |
| 6,017,198 | A | 1/2000 | Traylor et al. | |
| 6,026,904 | A | 2/2000 | Burd et al. | |
| 6,045,333 | A | 4/2000 | Breit | |
| 6,167,960 | B1 | 1/2001 | Moya | |
| 6,168,388 | B1 | 1/2001 | Hughes et al. | |
| 6,189,613 | B1 | 2/2001 | Chachula et al. | |
| 6,216,788 | B1 | 4/2001 | Wilson | |
| 6,269,880 | B1 | 8/2001 | Landry | |
| 6,354,371 | B1 * | 3/2002 | O'Blanc | 166/69 |
| 6,357,530 | B1 | 3/2002 | Kennedy et al. | |
| 6,394,183 | B1 | 5/2002 | Schrenkel et al. | |
| 6,497,287 | B1 | 12/2002 | Podio et al. | |
| 6,508,308 | B1 | 1/2003 | Shaw | |
| 6,547,532 | B1 * | 4/2003 | Gonzalez et al. | 417/197 |

FOREIGN PATENT DOCUMENTS

| | | |
|---|---|---|
| GB | 2264147 | 8/1993 |
| WO | WO92/0837 | 5/1992 |
| WO | WO93/07391 | 4/1993 |
| WO | WO97/11254 | 3/1997 |

OTHER PUBLICATIONS

"Schlumberger HydroLift—Jet and piston pump systems for temporary and long-term applications", Schlumberger catalog—SMP-5849, 15 pgs, Jun. 2003, U.S.

"HydroLift standard- and reverse-circulation jet pumps in sliding sleeves", Schlumberger catalog—SMP-5849-4, 2 pgs, Jun. 2003, U.S.

* cited by examiner

SYSTEM AND METHOD FOR OFFSHORE PRODUCTION WITH WELL CONTROL

BACKGROUND

In the production of hydrocarbon based fluids, artificial lift equipment can be used to produce a fluid to a surface location or other desired location. For example, a jet pump may be utilized to provide the artificial left. However, operation of a jet pump typically requires the use of two flow passages. A power fluid is pumped down through a flow passage to the jet pump, and commingled production is returned through another flow passage to the surface or other collection point. Due to the dual flow passage configuration, the use of jet pumps in some environments, e.g. offshore production, is rendered difficult as a result of regulations requiring that well control be maintained in a catastrophic situation. Specifically, such well control can be difficult and/or expensive because both fluid passages used in operation of the jet pump must be closed in a catastrophic event.

SUMMARY

In general, the present invention provides a system and methodology for utilizing one or more jet pumps in a variety of applications, including offshore production applications. The system comprises a production control unit having a recovery valve deployed at the bottom of a jet pump assembly to provide full subsurface control utility. The positioning of the recovery valve enables full control of well fluid flow in the wellbore with a single valve. Furthermore, the jet pump assembly can be delivered downhole in a single operation to save time and cost. The system also enables the retrofitting of existing wells with the production control unit.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method of providing artificial left for fluids found in a subterranean environment. The system and method are useful in, for example, the production of hydrocarbon based fluids in offshore environments. However, the devices and methods of the present invention are not limited to use in the specific applications that are described herein.

Figure 1:
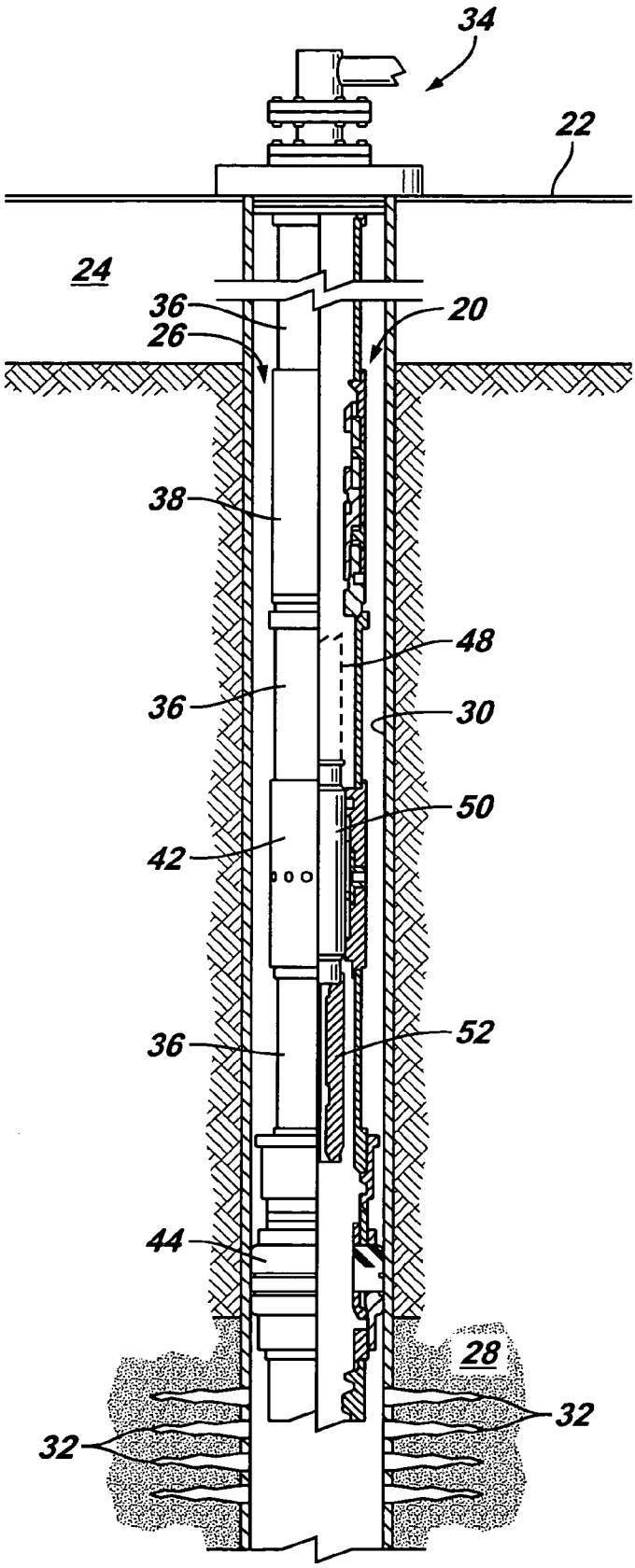
FIG. 1 is a front elevational view of a system for lifting fluids, according to an embodiment of the present invention.

Referring generally to FIG. 1, a system 20 is illustrated according to an embodiment of the present invention. The system 20 may be mounted on a platform 22 in an offshore environment 24. System 20 extends downwardly from platform 22 into a wellbore 26 and to a production formation 28 containing a desired production fluid or fluids. It should be noted that system 20 also can be used in onshore applications in which platform 22 would comprise an onshore surface location.

In the embodiment illustrated, wellbore 26 is lined with a casing 30 having perforations 32. Production fluid flows from formation 28 into wellbore 26 through perforations 32. From this location, system 20 is able to lift the fluids to, for example, a wellhead 34 on platform 22.

In the illustrated example, system 20 comprises a tubing 36 that extends downwardly into wellbore 26 from wellhead 34. A shallow subsurface safety valve 38 may be connected along tubing 36. Below the subsurface safety valve 38, tubing 36 extends to a downhole completion 40 that includes a downhole receptacle 42. Downhole receptacle 42 may comprise, for example, a sliding sleeve or a standard hydraulic pump bottom hole assembly. Downhole completion 40 may also comprise a packer 44. In this embodiment, packer 44 is positioned below downhole receptacle 42. The packer is positioned to seal the annulus between tubing 36 and wellbore casing 30, as illustrated best in FIG. 1.

Downhole receptacle 42 is designed to receive a production control unit 46 which may be delivered or retrieved from downhole receptacle 42 by, for example, a deployment system 48 (shown in dashed lines). Examples of deployment systems comprise slickline or wireline deployment systems. In the embodiment illustrated, production control unit 46 comprises a jet pump 50 disposed in cooperation with a subsurface safety valve 52. Subsurface safety valve is deployed in tubing 36 below jet pump 50. In at least some embodiments, subsurface safety valve 52 may be positioned below jet pump 50 and connected thereto to facilitate selective deployment of the production control unit 46 to downhole receptacle 42 as a single unit and in a single trip downhole.

Figure 2:
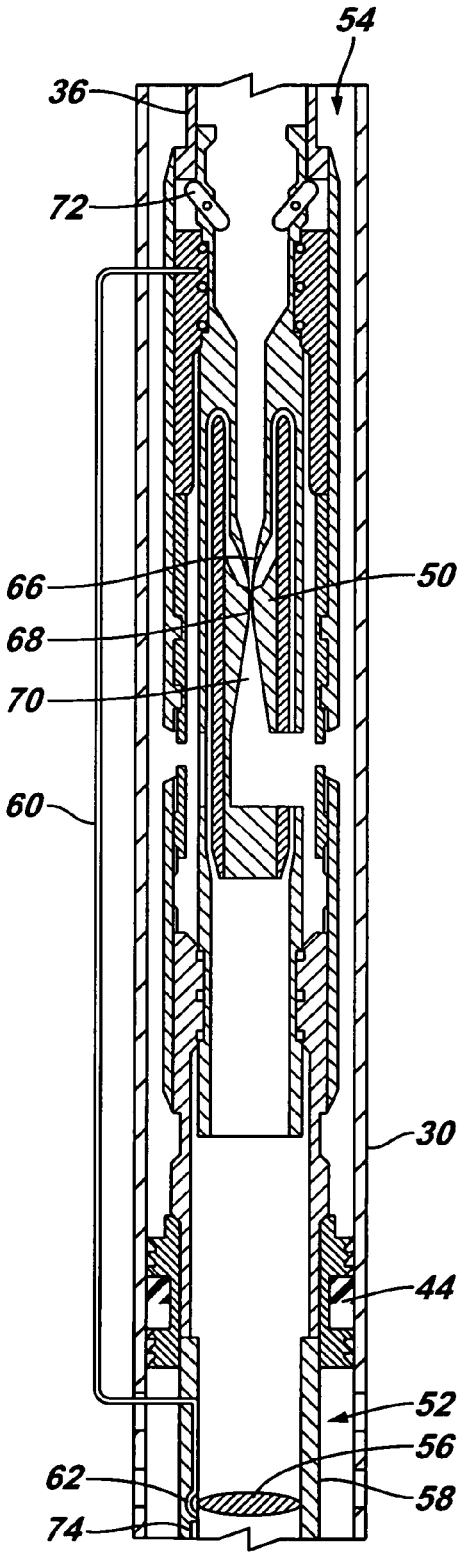
FIG. 2 is a cross-sectional view of an embodiment of a production control unit that may be utilized in the system illustrated in FIG. 1.

Referring generally to FIG. 2, the details and operation of system 20 are readily explained. In this embodiment, jet pump assembly 50 is illustrated as operating in standard circulation mode. In other words, power fluid is pumped down through tubing 36, and the commingled production is returned up through an annulus 54 between tubing 36 and casing 30. Subsurface safety valve 52 is operated by power fluid pressure which is used to selectively open valve 52, enabling the upward flow of well fluid to jet pump assembly 50.

Although other types of subsurface safety valves may be utilized, the illustrated valve 52 comprises a flapper valve 56 positioned in a valve body 58. The flapper valve 56 is opened via the pressure of power fluid supplied through a conduit 60. Conduit 60 may be formed as internal porting or as an external conduit. Regardless, when power fluid pressure is applied to operate jet pump assembly 50, the pressurized fluid is transferred through conduit 60 to open flapper valve 56. An integral self equalizing circuit 62 may be formed in subsurface safety valve 52 to permit the higher reservoir pressures to be "bled" through the valve, thereby equalizing the pressure on both sides of the flapper valve 56 to facilitate opening of the valve.

In the embodiment illustrated, valve 52 is normally in a closed position, e.g. flapper valve 56 blocks flow through valve body 58. The valve may be biased to the closed position by virtue of wellbore pressure and/or the use of biasing devices, such as a spring, to move the valve to the closed position. Thus, in the event flow of power fluid is manually or accidentally turned off, the delivery of pressurized power fluid through conduit 60 is stopped, and the subsurface safety valve 52 returns to its normally closed position. By utilizing packer 44 and the subsurface safety valve 52 positioned below jet pump assembly 50, complete well control is maintained even after cessation of power fluid flow. Packer 44 blocks upward flow of well fluid intermediate tubing 36 and casing 30, while valve 52 blocks all upward flow through valve body 58 when the valve is closed. Accordingly, well fluid cannot flow upwardly through the wellbore even in the event of catastrophic failure above downhole completion 40.

Jet pump assembly 50 generally comprises a jet pump 64 having a nozzle 66, a throat 68 and a diffuser 70. Power fluid is pumped downwardly through tubing 36 and into nozzle 66. The power fluid continues to flow through the constricted throat 68 before expanding in diffuser 70. The flow through throat 68 creates a low-pressure area that draws on wellbore fluid surrounding jet pump 64. The wellbore fluid is mixed with the power fluid in diffuser 70 and forced outwardly into annulus 54. Simultaneously, the pressurized power fluid acts on subsurface safety valve 52 via conduit 60 to maintain the valve in an open position. Thus, a continuous supply of well fluid is available for commingling with the power fluid at jet pump 64. Annulus 54 conducts this mixed fluid to a desired location, such as wellhead 34.

Figure 3:
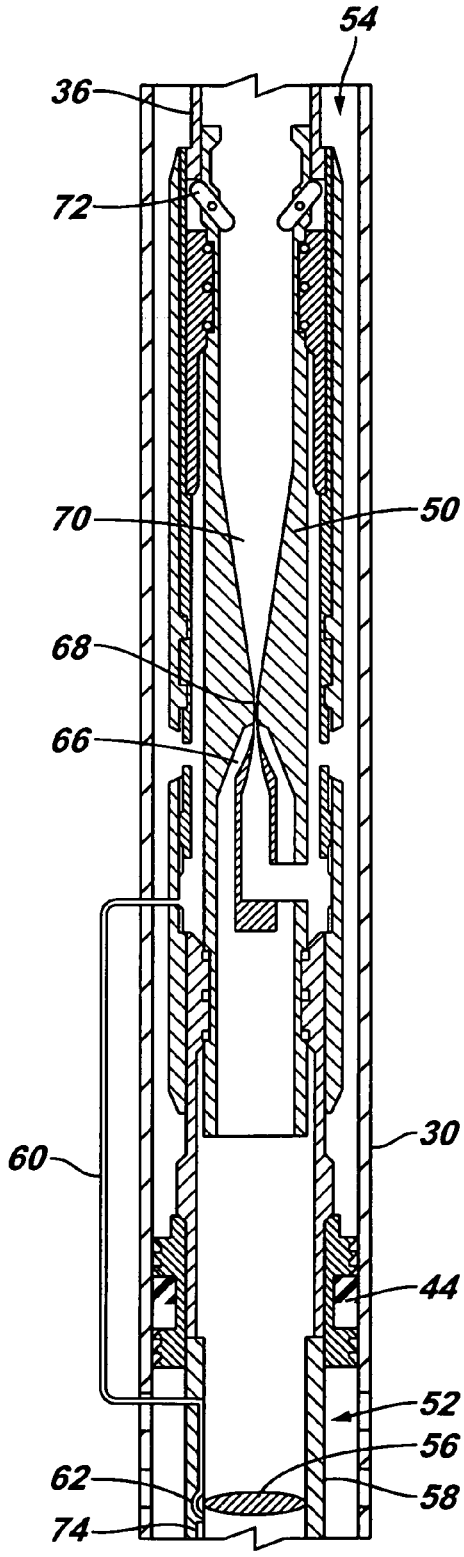
FIG. 3 is a view similar to that of FIG. 2 but showing an alternate embodiment of the production control unit.

In another embodiment, system 20 is operated in a reverse circulation mode, as illustrated in FIG. 3. In this embodiment, power fluid is pumped down through annulus 54, and the commingled fluid is conveyed upwardly through tubing 36. As illustrated, power fluid flows downwardly along annulus 54 and into nozzle 66. From nozzle 66, the power fluid flows upwardly through throat 68 and into diffuser 70. As with the embodiment illustrated in FIG. 2, conduit 60 is utilized to direct the pressurized power fluid to subsurface safety valve 52, e.g. flapper valve 56. Once valve 52 is open, well fluid flows upwardly through valve body 58 to jet pump assembly 50. As with the previous embodiment, the well fluid is drawn into jet pump 64 and mixed with the power fluid. This commingled fluid is directed upwardly through tubing 36 to a desired location, such as wellhead 34. In either of these embodiments, a lock mandrel 72 may be used to secure production control unit 46 at a landed position in downhole receptacle 42. A variety of mechanisms can be used to hold production control unit 46 at the landed position until the production control unit 46 is released by applying sufficient upward force or other release input. The production control unit 46 then may be retrieved from wellbore 26 by, for example, deployment system 48.

Production control unit 46 may be deployed as a single unit with combined jet pump assembly 50 and subsurface safety valve 52 on, for example, slickline 48. This "single run" downhole substantially reduces the cost of installation and enables the retrofitting of a wide variety of existing installations fitted with sliding sleeves or other downhole receptacles. The production control unit 46 is simply delivered downhole, via deployment system 48, and into engagement with an appropriate downhole receptacle 42. The ultimate landed position of production control unit 46 may locate valve 52 either above packer 44 (see FIG. 1) or through packer 44 (see FIGS. 2 and 3). Also, subsurface safety valve 52 may be combined with jet pump assembly 50 by a variety of mechanisms, including integral manufacture, threaded connectors or other devices enabling the combined deployment.

The production control unit 46 also may be utilized in a variety of other applications. For example, production control unit 46 may be used for well testing in both on and offshore environments. In this application, production control unit 46 comprises a wellbore parameter sensor 74 positioned to sense a desired wellbore parameter. Subsurface valve 52 provides a reliable flow valve that enables the collection of consistent well recovery testing data while maintaining well control. One example of wellbore parameter sensor 74 is a recording pressure gauge positioned proximate the bottom of production control unit 46.

In another application, production control unit 46 is utilized as a temporary, early production control system in both on and offshore environments. For example, when wells are batch drilled offshore, there can be considerable lag time between drilling and installing of permanent artificial lift completions. During this lag time, a simple, basic completion can be installed. The simple, basic completion can comprise system 20 utilized during the lag period by installing a temporary packer and sliding sleeve completion. Subsequently, production control unit 46 is installed as described above to enable production prior to installation of the permanent, artificial lift equipment.

In another application, production control unit 46 can be used as a temporary backup for artificial lift equipment, such as electric submersible pumping systems, in both on and offshore environments. For example, in the event an electric submersible pumping system fails, a production control unit can temporarily be utilized, provided the downhole completion has a packer and a downhole receptacle, e.g. a sliding sleeve. The production control unit enables production until the completion can be removed and the electric submersible pumping system replaced.

The system 20 also can be used for permanent artificial lift production in both on and offshore environments. The combination of jet pump and safety valve in a single production control unit provides an artificial lift system that is easy to deploy and retrieve while providing the desired well control.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of controlling fluid flow in a wellbore, comprising:

delivering a jet pump and a safety valve to a wellbore location in a single trip downhole, wherein delivering comprises delivering the jet pump and the safety valve via a slickline; and controlling the safety valve to enable selective flow of fluid upwardly through the wellbore via the jet pump.

2. A method of controlling fluid flow in a wellbore comprising:

delivering a jet pump and a safety valve to a wellbore location in a single trip downhole, wherein delivering comprises delivering the jet pump and the safety valve via a wireline; and controlling the safety valve to enable selective flow of fluid upwardly through the wellbore via the jet pump.

3. A method of controlling fluid flow in a wellbore, comprising:

delivering a jet pump and a safety valve to a wellbore location in a single trip downhole; and controlling the safety valve to enable selective flow of fluid upwardly through the wellbore via the jet pump; and operating the jet pump by pumping power fluid down through a well tubing, through the jet pump and up through an annulus surrounding the well tubing.

4. A method of controlling fluid flow in a wellbore, comprising:

delivering a jet pump and a safety valve to a wellbore location in a single trip downhole; and controlling the safety valve to enable selective flow of fluid upwardly through the wellbore via the jet pump, wherein controlling comprises opening the safety valve via pressure of power fluid applied to operate the jet pump.

5. The method as recited in claim 4, further comprising operating the jet pump by pumping power fluid down through an annulus formed around a well tubing, through the jet pump and up through the well tubing.

6. The method as recited in claim 4, further comprising locating a packer in the wellbore, wherein delivering comprises delivering the safety valve to a position proximate the packer.

7. A method of controlling fluid flow in a wellbore, comprising:

delivering a jet pump and a safety valve to a wellbore location in a single trip downhole; and controlling the safety valve to enable selective flow of fluid upwardly through the wellbore via the jet pump; and deploying a sliding sleeve at the wellbore location to receive the safety valve.

8. A method of utilizing a wellbore completion having a downhole receptacle above a packer, comprising:

moving a production control unit, having a jet pump and a safety valve, into engagement with the downhole receptacle; and hydraulically coupling the jet pump and the safety valve to enable opening of the safety valve via the pressure of power fluid directed through the jet pump.

9. The method as recited in claim 8, wherein moving comprises connecting the production control unit to a sliding sleeve.

10. The method as recited in claim 8, wherein moving comprises deploying the production control unit with a slickline.

11. The method as recited in claim 8, wherein moving comprises locating the safety valve above the packer.

12. The method as recited in claim 8, further comprising operating the jet pump to produce a wellbore fluid.

13. The method as recited in claim 8, further comprising preventing all upward flow of wellbore fluid in the wellbore when the jet pump is not operating.

14. The method as recited in claim 8, wherein moving comprises retrofitting the wellbore completion with the production control unit.

15. The method as recited in claim 8, wherein moving comprises temporarily installing the production control unit prior to installation of other artificial lift equipment.

16. A system for controlling fluid flow in a wellbore, comprising:

means for utilizing a power fluid to produce a wellbore fluid;

means for selectively preventing all upward flow of fluid in the wellbore; and means for simultaneously delivering the means for utilizing and the means for selectively preventing to a desired wellbore position, wherein the means for simultaneously delivering comprises a slickline.

17. The system as recited in claim 16, wherein the means for utilizing comprises a jet pump.

18. The system as recited in claim 16, wherein the means for selectively preventing comprises a flapper valve.

* * * * *